US005620118A

United States Patent [19]

Kolton et al.

[11] Patent Number: 5,620,118

[45] **Date of Patent: *Apr. 15, 1997**

[54] GARMENT HANGER

[75] Inventors: Chester Kolton, Westfield; Stuart S. Spater, Livingston, both of N.J.

[73] Assignee: B&G Plastics, Inc., Newark, N.J.

[ * ] Notice: The term of this patent shall not extend beyond the expiration date of Pat. No. 5,501,378.

[21] Appl. No.: 369,185

[22] Filed: Jan. 5, 1995

Related U.S. Application Data

[63] Continuation-in-part of Ser. No. 180,032, Jan. 11, 1994, and Ser. No. 279,280, Jul. 22, 1994, Pat. No. 5,501,378.

[51] Int. Cl.[6] ..... A47G 25/14

[52] U.S. Cl. ..... 223/85; 223/DIG. 1; 223/87

[58] Field of Search ..... 223/87, 85, DIG. 1, 223/1, 94, 89, 88; D6/315

[56] References Cited

U.S. PATENT DOCUMENTS

| | | | |
|---|---|---|---|
| 3,243,087 | 3/1966 | Pulitzer | 223/DIG. 1 |
| 3,755,859 | 9/1973 | Solari | 223/DIG. 1 |
| 3,790,045 | 2/1974 | Rigel et al. | 223/DIG. 1 |
| 3,945,500 | 3/1976 | Mecksworth | 223/DIG. 1 |
| 5,079,804 | 1/1992 | Gregurich et al. | 24/17 AP |
| 5,328,065 | 7/1994 | Kolton et al. | 223/DIG. 1 |
| 5,501,378 | 3/1996 | Kolton et al. | 223/87 |

FOREIGN PATENT DOCUMENTS

| | | | |
|---|---|---|---|
| 310204 | 10/1955 | Switzerland | 223/DIG. 1 |

*Primary Examiner*—Bibhu Mohanty
*Attorney, Agent, or Firm*—Robin, Blecker, Daley & Driscoll

[57] ABSTRACT

A garment hanger is comprised of a one-piece body having a hook portion for the receipt of a display rod, a central portion depending from the hook portion, the body defining in the central portion an opening therethrough and a garment support member disposed in the opening and movable relative to the body. A lower portion of the hanger defines a fold line segment depending from the central portion and a flap segment depending from the fold line segment, the central portion, the fold line segment and the flap segment jointly defining a slot in the body. The flap segment has a latching projection thereon and the central portion defines a passage therethrough for the flap projection, the central portion having a part thereof circumscribing the passage and in facing relation to the flap segment on folding thereof which is thickened with respect to adjacent parts of the central portion.

16 Claims, 5 Drawing Sheets

GARMENT HANGER

CROSS-REFERENCE TO RELATED APPLICATIONS

This application is a continuation-in-part of U.S. patent applications Ser. No. 08/180,032, filed on Jan. 11, 1994, and Ser. No. 08/279,280, filed on Jul. 22, 1994 now U.S. Pat. No. 5,501,378.

FIELD OF THE INVENTION

This invention relates generally to hangers for garments and pertains more particularly to hangers for enhanced retention of garments, such as ties.

BACKGROUND OF THE INVENTION

FIGS. 1–3 of the above-referenced '280 application depict a presently known commercial tie hanger, comprised of an integral plastic body having first and second foldable panels, the second panel having three openings for the looping of a tie therethrough. The first panel has projections at a lower portion thereof and the second flap portion has latching openings. In use, when a tie has been applied to the second panel, the panels are folded and latched in folded condition by fording the projections into the latching openings. A quite extensive amount of plastic material is involved in the hanger, i.e., the first and second panels are generally coextensive. Further, the configuration of the projections and latching openings is such that security does not attend the hanger. Thus, an unscrupulous shopper can interchange ties and hangers, placing a hanger with a lower price indication with a tie of far greater price.

By way of further introduction to the subject invention, reference is made to copending, commonly-assigned application Ser. No. 179,909, filed on Jan. 11, 1994. That application discloses a garment hanger comprised of a one-piece body having a hook portion for the receipt of a display rod, a central portion depending from the hook portion and having first and second openings therein, and a lower portion defining a fold line segment depending from the central portion with a third opening disposed in the fold line segment and a flap segment depending from the fold line segment. The central portion and the flap segment define coactive structure for retaining the flap segment against the central portion on folding of the flap segment about the fold line segment. The coactive structure is preferably comprised of first and second projections on the flap segment adjacent respective lateral margins thereof and first and second latching openings in the central portion adjacent respective lateral margins thereof.

In use of the hanger, with the flap segment unfolded, a garment, such as a tie, is looped through the first and second openings and then passed through the third opening. The flap is now folded against the garment and latched to the central portion.

Advantage attends the hanger as against the first above-discussed hanger, in that it requires substantially less plastic material. However, the security disadvantage, above noted, likewise attends this hanger.

The tie hanger of above-referenced, copending, commonly-assigned application Ser. No. 279,280 is depicted in FIGS. 1–5 hereof. Referring thereto, garment hanger 40 is comprised of a one-piece synthetic plastic body having a hook portion 42 with an opening 42*a* for the receipt of a display rod. A central portion 44 of hanger 40 depends from hook portion 42 and has a garment support member 46 disposed in opening 48 and cantilever-supported by the central portion. The central portion also includes latching openings 50 and 52 adjacent respective lateral margins thereof.

A lower portion of hanger 40 has a fold line segment 54, depending from the central portion, constituted by thinning out the one-piece body to have a lesser thickness in fold line segment 54, and a flap segment, depending from the fold line segment and including a panel 56 with latching projections 58 and 60.

The latching openings and projections constitute coactive structure for retaining the flap segment against the central portion on folding of the flap segment about the fold line segment.

The hanger of the '280 application incorporates non-releasable projections and latching recess structure shown in FIGS. 1–3, which is fully explained in commonly-assigned U.S. Pat. No. 5,005,741.

The hanger central portion, the fold line segment and the flap segment jointly define slot 62, which has an interior end with which the fold line segment is contiguous and opens into the left side margin of hanger 40. The fold line segment provides cantilever support for the flap segment.

Referring to FIGS. 4 and 5, hanger 40 is shown in assembly with tie 64, the tie having a first part 66 looped about support member 46 and a second part 68 extending through slot 66 and disposed between the central portion and the flap segment.

In reaching the assembly of FIGS. 4 and 5, an assembler forms a tie with looped first part 66 and displaces both support member 46 and panel 52 outwardly of the plane of the hanger body, e.g., rearwardly of the plane of FIG. 4. The looped first part 66 is then dressed over and about support member 46 and the second part 68 is then inserted into slot 62. Panel 52 is then folded about the fold line segment and projections 58 and 60 are forced into openings 50 and 52.

Advantage attends the hanger of the '280 application in that its open slot 62 greatly facilitates assembly of the hanger with a tie. Further, it provides the security, lacking in the earlier above-discussed hangers. Since cutting is necessary to open the hanger, it evidently can be associated with only one tie and not reused with another tie.

SUMMARY OF THE INVENTION

The present invention has as its primary object the provision of a further version of the garment hangers of the type last above discussed, particularly for hanging ties.

In attaining the above and other objects, the present invention provides a hanger comprised of a one-piece body having a hook portion for the receipt of a display rod, a central portion depending from the hook portion, the body defining in the central portion an opening therethrough and a garment support member disposed in the opening and movable relative to the body. A fold line portion depends from the central portion and a flap segment depends from the fold line segment.

The central portion, the fold line segment and the flap segment jointly define a slot in the body which opens into a margin of the body. The flap has a projection extending forwardly thereof.

The hanger has a generally planar rear surface and the central portion has a part of increased thickness relative to the remainder of the central part and extending forwardly of a front surface of the hanger, the increased thickness part defining a passage therethrough opening into the front and rear hanger surfaces, the flap projection being configured complementally with the passage to be insertable therein and to be retentively retained outwardly of the hanger rear surface.

The hanger of the invention affords the security aspect of the hanger of the '280 application, as well as the open slot facilitating tie receipt. Further advantage attends the nesting of the expanded width passage bounding structure within the folded parts of the hanger.

The foregoing and other objects and features of the invention will be further understood from the following detailed description of a preferred embodiment thereof and from the drawings, wherein like reference numerals identify like components throughout.

DETAILED DESCRIPTION OF THE PREFERRED EMBODIMENT AND PRACTICES

Figure 3:
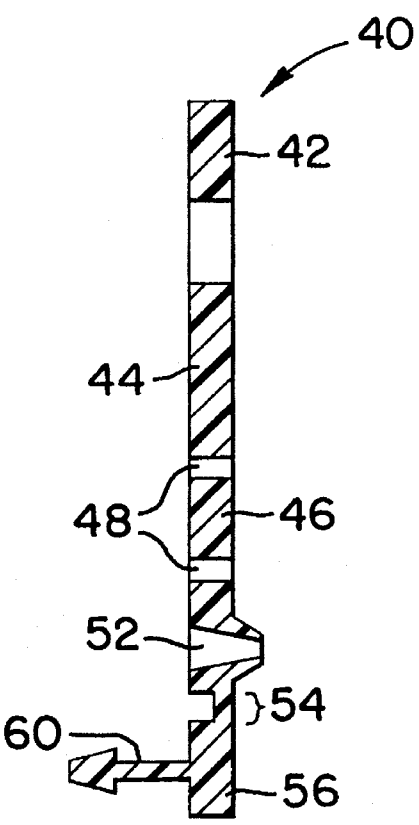
FIG. 3 is a sectional view of the FIG. 1 hanger as would be seen from broken plane III—III of FIG. 1.
Figure 1:
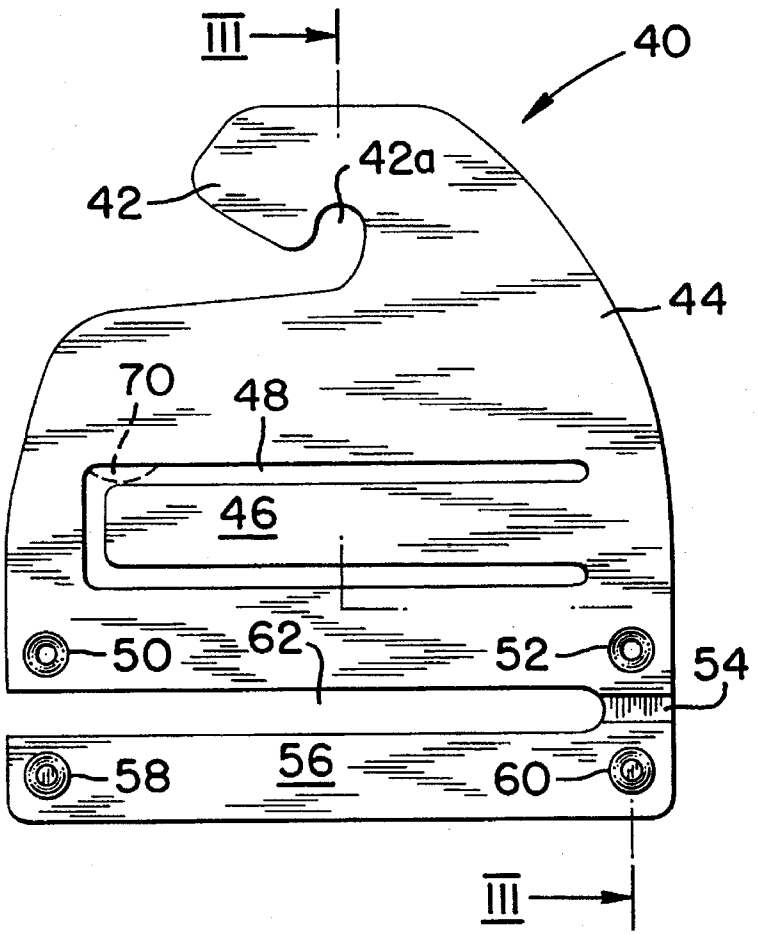
FIG. 1 is a front elevational view of a hanger in accordance with the '280 application.
Figure 2:
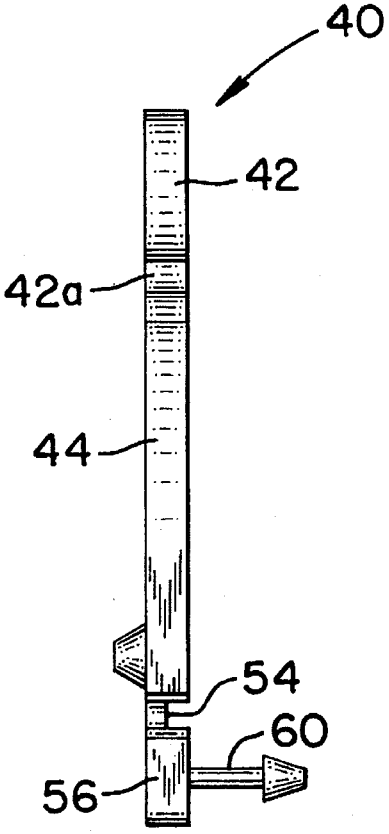
FIG. 2 is a left side elevational view of the FIG. 1 hanger.
Figure 4:
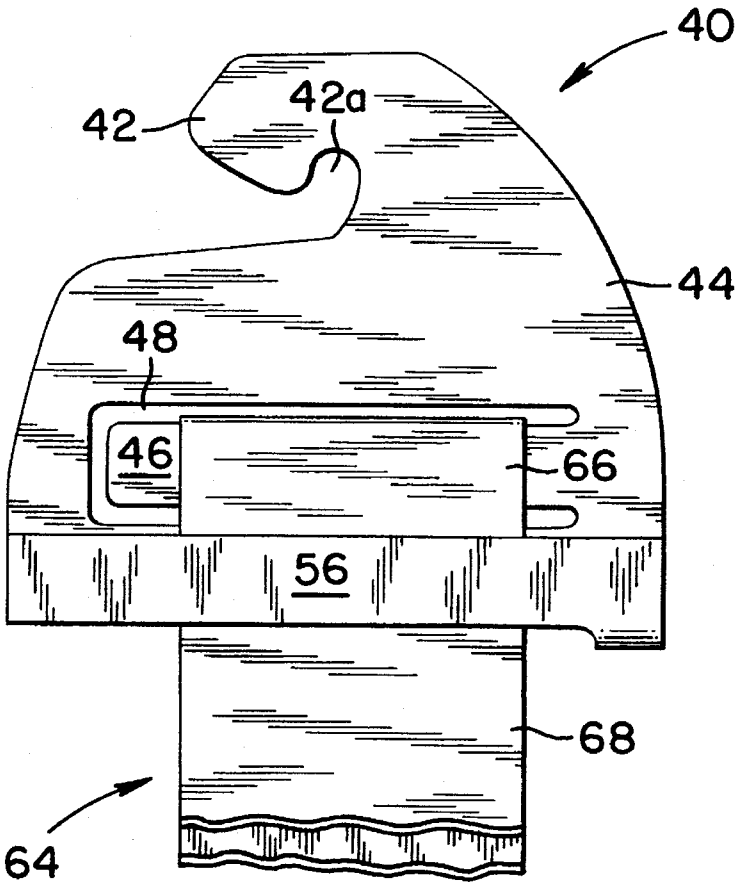
FIG. 4 is a front elevational view of the FIG. 1 hanger assembled with a tie.
Figure 5:
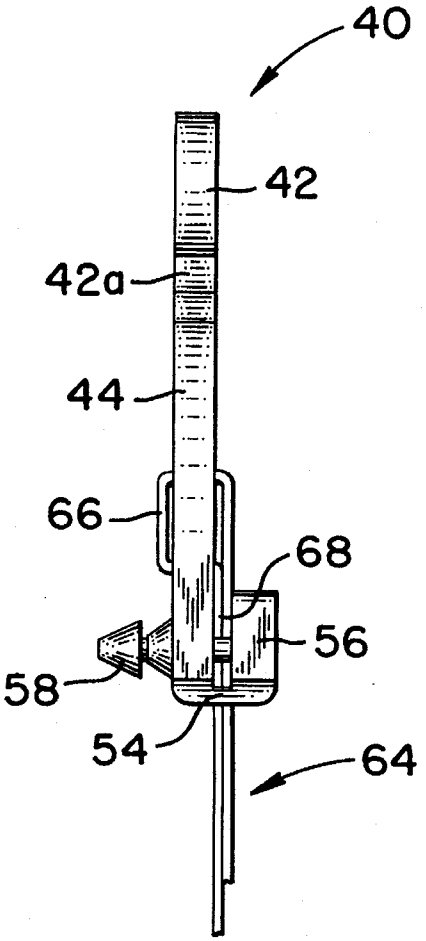
FIG. 5 is a left side elevational view of the FIG. 4 assembly.
Figure 8:
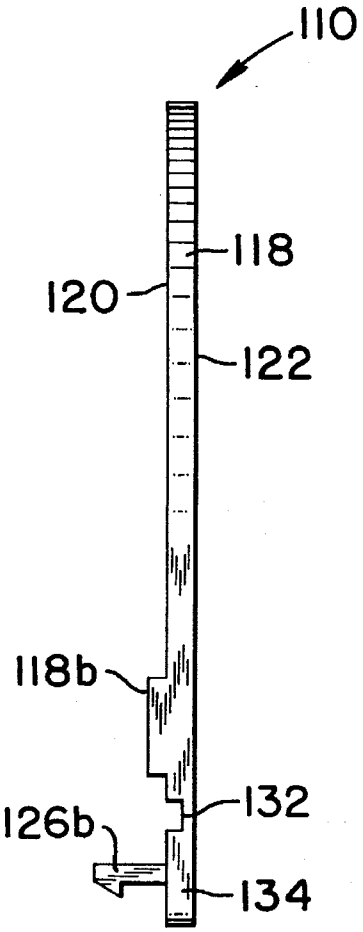
FIG. 8 is a right side elevational view of the FIG. 6 hanger.
Figure 6:
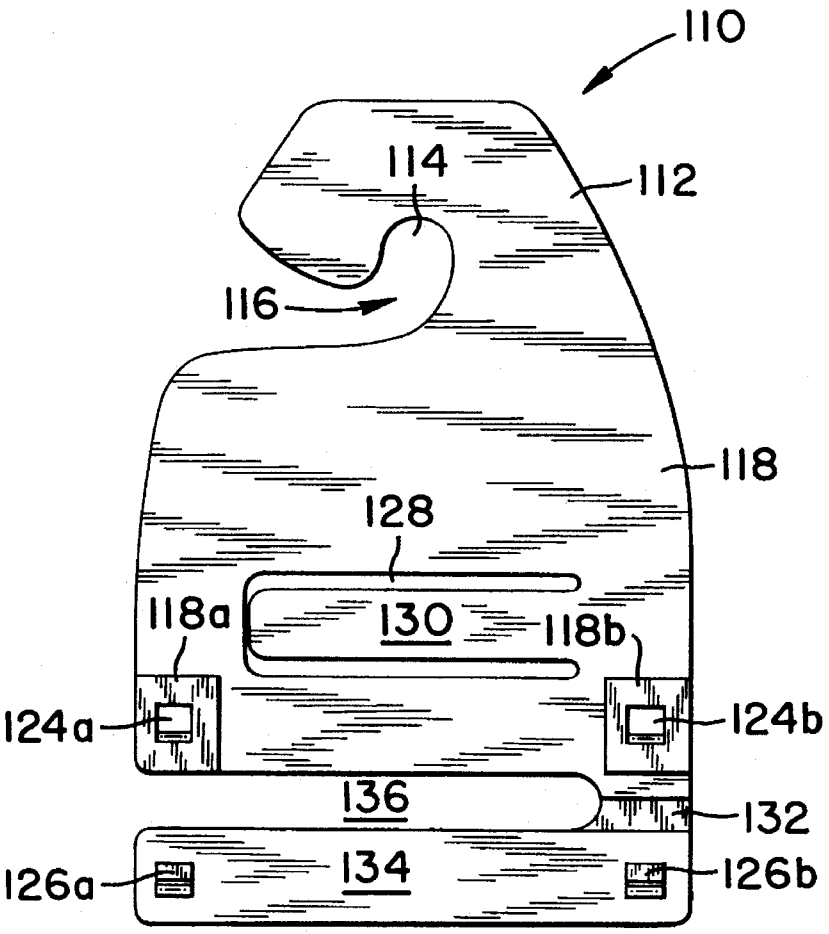
FIG. 6 is a front elevational view of a hanger in accordance with the subject invention.
Figure 7:
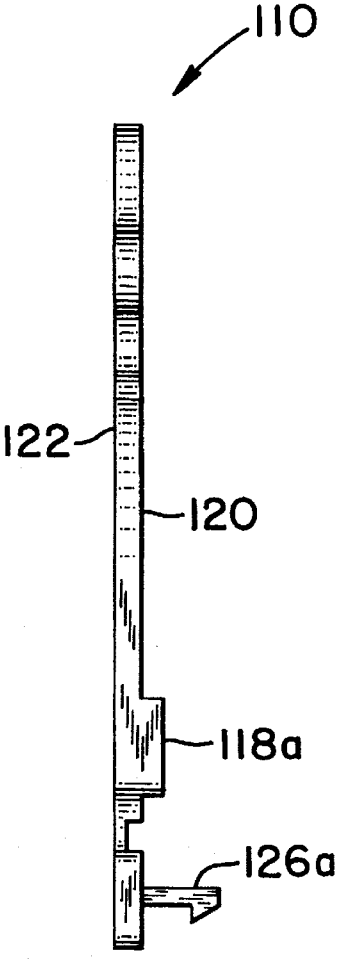
FIG. 7 is a left side elevational view of the FIG. 6 hanger.

Referring to FIGS. 6–8, garment hanger 110 is comprised of a one-piece synthetic plastic body having a hook portion 112 with an opening 114, accessible through channel 116 for the receipt of a display rod. A central portion 118 of hanger 40 depends from hook portion 112. Hanger 110 has front surface 120 and rear surface 122.

Central portion 118 has thickened areas 118*a*, 118*b* and latching openings 124*a* and 124*b* extend through the thickened areas, opening into each of front surface 120 and rear surface 122. Opening 128 is formed in central portion 118, which has garment support member 130 disposed in opening 128 and cantilever-supported by the central portion.

A lower portion of hanger 110 has a fold line segment 132, depending from central portion 118, constituted by thinning out the one-piece body to have a lesser thickness in fold line segment 132. A flap segment, depends from the fold line segment and includes a panel 134 with latching projections 126*a* and 126*b*.

The latching openings and projections constitute coactive structure for retaining the flap segment against the central portion on folding of the flap segment about the fold line segment.

The hanger central portion, the fold line segment and the flap segment jointly define slot 136, which has an interior end with which the fold line segment is contiguous and opens into the left side margin of hanger 110. The fold line segment provides cantilever support for the flap segment.

Figure 9:
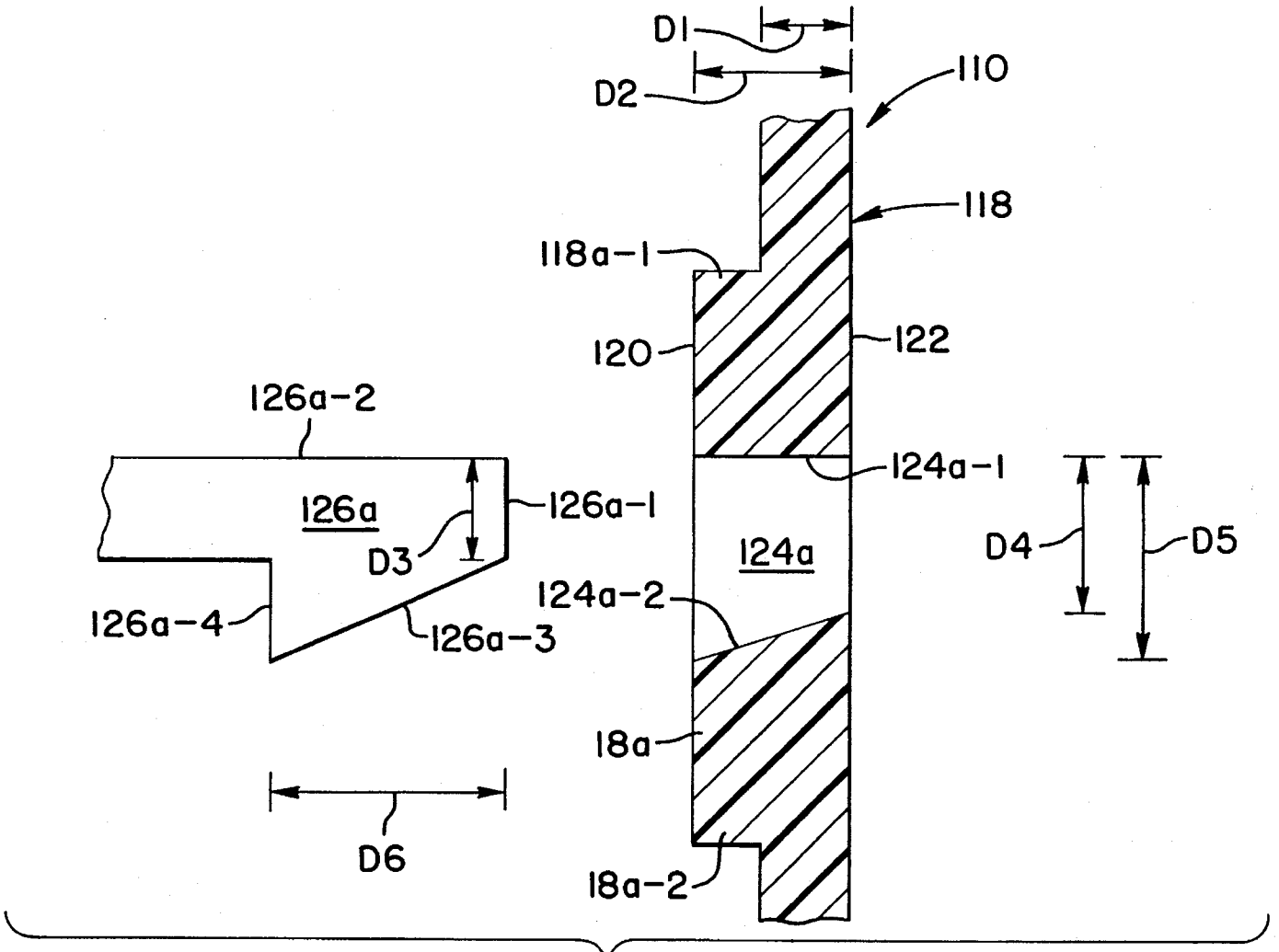
FIG. 9 is an enlarged partial view showing the hanger central portion thickened part in section centrally of the passage therethrough and the flap segment projection, not in section.

Referring to FIG. 9, hanger 110 has a dominant thickness D1 between front and rear surfaces 120 and 122, but, in thickened area 118*a* of central portion 118, it has a thickness D2, exceeding thickness D1 generally by two-fold.

Projection 126*a* is configured in part complementally with passage 124*a* as discussed in detail below, to be insertable therein and retentively retained outwardly of rear surface 122.

Passage 124*a* is bounded by mutually acutely-angled surfaces 124*a*-1 and 124*a*-2, the former preferably being horizontal and the latter an acute angle to the horizontal. As is also seen in FIG. 9, projection 126*a* has a surface 126*a*-1 generally orthogonal to surface 126*a*-2, an angled surface 126*a*-3 and a surface 126*a*-4, parallel to surface 126*a*-1. Projection 126*a* will be seen to have dimension D3 in surface 126*a*-1, which is less than passage entry and exit dimensions D4 and D5, facilitating entry thereof into and through passage 124*a*. Projection 126*a* also has dimension D6.

Figure 10:
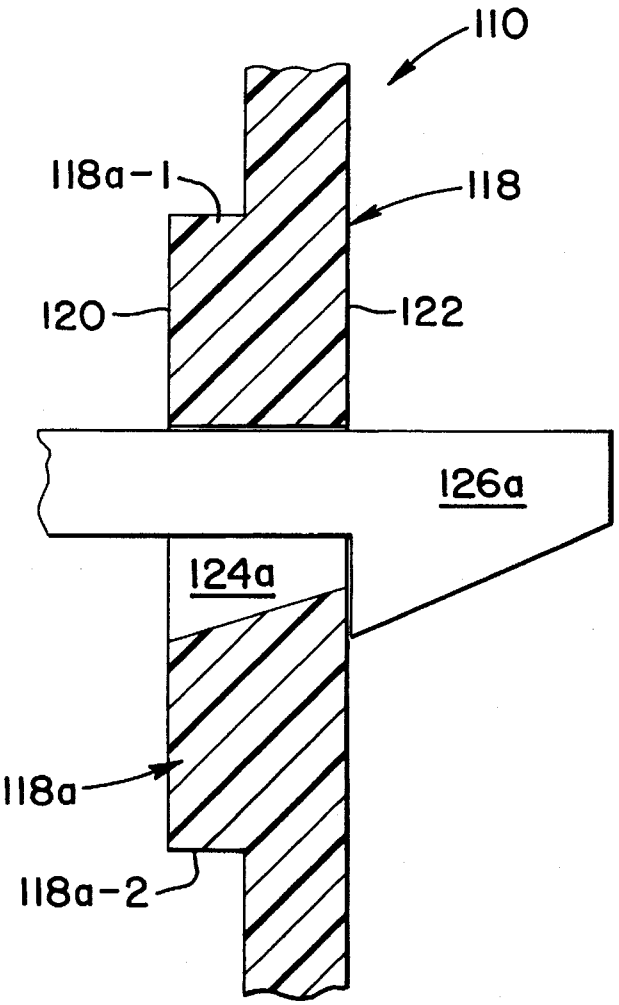
FIG. 10 is a repeat showing of the FIG. 9 components in assembled relation.

In reaching the FIG. 10 assembly, projection 126*a* is inserted into passage 124*a* and forced therethrough. In an initial phase of assembly, the complemental configuration of the projection and passage permits ready, friction-free insertion. Thereafter, the remnant of the projection, i.e., that portion thereof outwardly of the passage (of measure D6–D2), is wedged into the passage. In the course of the wedging, thickened part 118*a* expands to facilitate projection entry since it is not bounded by hanger material at its upper and lower limits 18*a*-1 and 18*a*-2.

Figure 11:
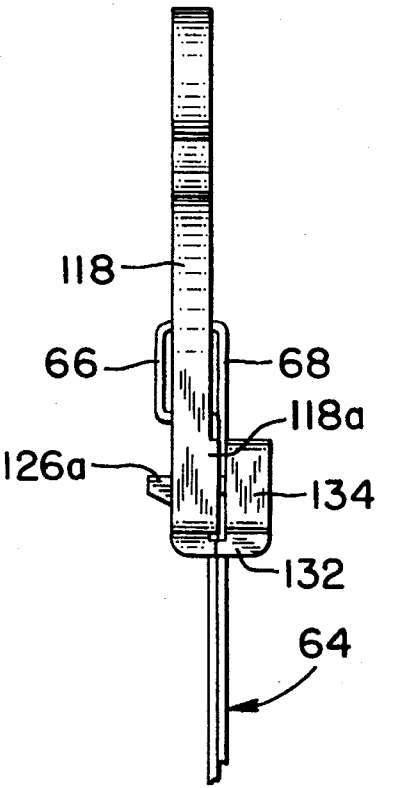
FIG. 11 is a left side elevational view of the FIG. 6 hanger assembled with a tie.

Once assembly is complete, as is seen in FIG. 11, projection 126*a* is retentively secured in its locked position as against manipulative withdrawal and cutting of the projection rearwardly of surface 122 is required to free the tie from the hanger.

The foregoing applies equally of course to projection 126*b* and passage 124*b*.

Various changes to the particularly disclosed embodiments and methods may evidently be introduced without departing from the invention. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. A garment hanger comprised of a one-piece body having a hook portion for the receipt of a display rod, a central portion depending from said hook portion, said body defining in said central portion an opening therethrough and a garment support member disposed in said opening and movable relative to said body and a lower portion defining a fold line segment depending from said central portion and a flap segment depending from said fold line segment, said central portion, said fold line segment and said flap segment jointly defining a slot in said body which opens into a margin of said body, said flap segment having a latching projection thereon, said central portion defining a passage therethrough for said flap projection, said central portion having a part thereof circumscribing said passage and in facing relation to said flap segment on folding thereof which is thickened with respect to adjacent parts of said central portion.

2. The hanger claimed in claim 1, wherein said fold line segment is contiguous with an interior end of said slot and provides cantilever support for said flap segment.

3. The hanger claimed in claim 1, wherein said projection is configured complementally with said passage to be insertable therein and retentively retained outwardly of a surface of said hanger not in facing relation to said flap segment on folding thereof.

4. The hanger claimed in claim 1 wherein said passage is bounded in part by opposed surfaces mutually forming an acute angle.

5. The hanger claimed in claim 4 wherein said tail portion projection has a surface forming an acute angle with said hanger surface not in facing relation to said flap segment on folding thereof.

6. The hanger claimed in claim 5 wherein both said acute angles are substantially equal.

7. A hanger comprised of a one-piece body having a hook portion for the receipt of a display rod, a central portion depending from said hook portion, said body defining in said central portion an opening therethrough and a garment support member disposed in said opening and movable relative to said body and a lower portion defining a fold line segment depending from said central portion and a flap segment depending from said fold line segment, said central portion, said fold line segment and said flap segment jointly defining a slot in said body, said flap segment having a latching projection thereon, said central portion defining a passage therethrough for said flap projection, a rear hanger surface being generally planar, said central portion having a part of increased thickness relative to the remainder of said central part and extending forwardly of a front surface of said hanger, said increased thickness part defining a passage therethrough opening into said front and rear hanger surfaces, said flap projection being configured complementally with said passage to be insertable therein and to be retentively retained outwardly of said hanger rear surface.

8. The hanger claimed in claim 7, wherein said passage is bounded by mutually acutely angled interior surfaces of said central portion.

9. The hanger claimed in claim 8 wherein one of said mutually acutely angled interior surfaces is generally orthogonal to said hanger front and rear surfaces.

10. The hanger claimed in claim 9 wherein said flap segment projection has a dimension lengthwise of said tail portion in excess of the thickness of said central portion part.

11. The hanger claimed in claim 10, wherein said passage has a first opening in said hanger front surface of dimension exceeding a dimension of a second opening of said passage in said hanger rear surface.

12. The hanger claimed in claim 7, wherein said slot opens into a side margin of said hanger.

13. In combination:

(a) a garment hanger comprised of a one-piece body having a hook portion for the receipt of a display rod, a central portion depending from said hook portion, said body defining in said central portion an opening therethrough and a garment support member disposed in said opening and movable relative to said body and a lower portion defining a fold line segment depending from said central portion and a flap segment depending from said fold line segment, said central portion, said fold line segment and said flap segment jointly defining a slot in said body which opens into a margin of said body, said flap segment having a latching projection thereon, said central portion defining a passage therethrough for said flap, said central portion having a part thereof circumscribing said passage and in facing relation to said flap segment on folding thereof which is thickened with respect to adjacent parts of said central portion; and (b) a garment having a first part looped about said garment support member and a second part extending through said slot, said garment second part being disposed between said central portion and said flap segment.

14. The hanger claimed in claim 13, wherein said fold line segment is contiguous with an interior end of said slot and provides cantilever support for said flap segment.

15. In combination:

(a) a hanger comprised of a one-piece body having a hook portion for the receipt of a display rod, a central portion depending from said hook portion, said body defining in said central portion an opening therethrough and a garment support member disposed in said opening and movable relative to said body and a lower portion defining a fold line segment depending from said central portion and a flap segment depending from said fold line segment, said central portion, said fold line segment and said flap segment jointly defining a slot in said body which opens into a margin of said body, said flap segment having a latching projection thereon, said central portion defining a passage therethrough for said flap projection, a rear hanger surface being generally planar, said central portion having a part of increased thickness relative extending forwardly of a front surface of said hanger, said increased thickness part defining a passage therethrough opening into said front and rear hanger surfaces, said flap projection being configured complementally with said passage to be insertable therein and to be retentively retained outwardly of said hanger rear surface; and (b) a garment having a first part looped about said garment support member and a second part extending through said slot, said garment second part being disposed between said central portion and said flap segment.

16. The hanger claimed in claim 15, wherein said fold line segment is contiguous with an interior end of said slot and provides cantilever support for said flap segment.

* * * * *